United States Patent [19]

Raffel

[11] Patent Number: 5,014,687

[45] Date of Patent: May 14, 1991

[54] MOUNTING FOR VIBRATING MOTOR

[75] Inventor: Mark J. Raffel, Port Washington, Wis.

[73] Assignee: Raffel Product Development Co., Port Washington, Wis.

[21] Appl. No.: 418,793

[22] Filed: Oct. 3, 1989

Related U.S. Application Data

[63] Continuation-in-part of Ser. No. 135,900, Dec. 21, 1987, abandoned, Continuation-in-part of Ser. No. 897,238, Aug. 18, 1986, abandoned.

[51] Int. Cl.[5] ..... A61H 1/00

[52] U.S. Cl. ..... 128/33; 128/41

[58] Field of Search ..... 128/33.41

[56] References Cited

U.S. PATENT DOCUMENTS

| | | | |
|---|---|---|---|
| 1,845,941 | 2/1932 | Stevens et al. | 128/33 |
| 2,345,438 | 3/1944 | Tompkins | 128/33 |
| 2,425,655 | 8/1947 | Tompkins | 128/33 |
| 2,539,712 | 1/1951 | Wettloufer | 128/33 |
| 2,674,993 | 4/1954 | Hamell | 128/33 |
| 2,833,276 | 5/1958 | Murphy | 128/33 |
| 2,921,578 | 1/1960 | Rabhan | 128/33 |
| 2,937,641 | 5/1960 | Oefinger | 128/33 |
| 3,035,572 | 5/1962 | Houghtaling | 128/33 |
| 3,613,673 | 10/1971 | Lattue | 128/33 |
| 3,799,154 | 3/1974 | Knop | 128/33 |
| 4,064,376 | 12/1977 | Yamada | 128/33 |
| 4,105,024 | 8/1978 | Raffel | 128/33 |
| 4,224,931 | 9/1980 | Nelkin | 128/33 |

FOREIGN PATENT DOCUMENTS

| | | | |
|---|---|---|---|
| 978437 | 11/1975 | Canada | 128/33 |

*Primary Examiner*—Edgar S. Burr
*Assistant Examiner*—Lisa E. Malvaso
*Attorney, Agent, or Firm*—Michael, Best & Friedrich

[57] ABSTRACT

A vibrator is disclosed for mounting on furniture in which a pair of vibrator motors is each mounted to an independent long relatively rigid resonator member capable of transmitting virations, the two long resonators for the respective motors being parallel to one another and mounted by non-rigid means such as a sheet of cardboard or springs to the remainder of the structure of the furniture. One form of complete unit comprises a non-rigid sheet containing two rigid rods each associated with an off-center vibrating motor, which underlies the surface of the furniture contacted by the user. A vibrator controller supplies the two vibrator motors with 60 Hertz pulsed D.C. current which is amplitude modulated at approximately 16 cycles per minute, with the modulation supplied to one motor 180° out of phase with the other motor so that the user experiences the sensation of moving wave. The user simultaneously receives a 16 cycle per minute alternating tactile stimulation, and a 60 Hertz audio wave which is aplitude modulated at 16 cycles per minute. The effect is somewhat similar to a Yoga chant and induces relaxation and a slower breathing rate. Other forms use rigid linear resonators attached to each vibrator and placed parallel to one another but not a permanent part of the furniture with which they are used.

11 Claims, 3 Drawing Sheets

MOUNTING FOR VIBRATING MOTOR

This application is a continuation of Ser. No. 07,135,900, filed Dec. 21, 1987 now abandoned, which in turn is a continuation-in-part of Ser. No. 06/897,238, filed Aug. 18, 1986 now abandoned.

BACKGROUND OF THE INVENTION

Non-rotating vibrators and vibrator controllers for furniture are well known as illustrated by previous patents to this patentee, such as Raffel U.S. Pat. No. 4,105,024, and a patent to Christensen, U.S. Pat. No. Re 31,503 herein incorporated by reference. Many other such patents exist.

However, in an effort to improve the relaxing effect of such vibrators, applicant has invented a novel physical system for applying vibrations to the furniture and ultimately to the user and at the same time has incorporated a novel excitation system which is believed to tend to induce the body of the user to respond to the preferred modulation cycle of approximately 10 to 20 cycles per minute. A range of 1 to 120 cycles per minute may be useful in some cases. Either modulation is superimposed on a frequency of 30 Hertz to 110 Hertz and preferably the 60 Hertz of rectified alternating current. A non-rotating vibrating motor is used rather than a rotating motor.

SUMMARY OF THE INVENTION

The invention of this application consists of both a physical system for mounting vibrators and applying the vibrations to an area of a piece of furniture and of an excitation system which is particularly effective in conjunction with the physical system. The precise electronic means used to excite the vibrators is not a part of this invention as the desired excitation can be achieved by many known electric or electronic means. One mode of excitation uses a current that will produce an audible hum in the 30 Hertz to 100 Hertz range. The 60 Hertz frequency of ordinary house current is suitable and convenient but not essential. A.C. house current must pass through a half wave rectifier in order to avoid flux reversal in the vibratory motors which are a part of the physical system and to obtain 60 pulses rather than 120. Other frequencies within the range may be used. In addition to the audible hum, the current furnished to the vibrator motors may have a very slow inaudible component preferably in a range of 10 to 20 cycles per minute, or within a range of 1 to 120 cycles per minute. This very low frequency takes the form of amplitude modulation superimposed on the faster 30–100 Hertz frequency, and it is important that it be supplied to one vibrator motor 180° out of phase with the other vibrator motor. The exact phase relationship may vary somewhat, but the most effective phase angle difference is 180° and the slow modulating frequency is preferably a sine wave form. However, the wave form may be altered to produce the effect of asymmetrical motion.

The physical system of Applicant's invention includes a long rod associated with each vibrator motor being mounted on said rod. In some cases, the motor frame itself is made integral with the rod. My system may include a softer material or materials such as plastic foam sheeting of cardboard or a layer of each which supports the rod for each motor in a way such that they remain parallel and spaced from one another and which are supported in the furniture in such a way as to transmit the vibrations from the rods to the surface of the furniture which is contacted by the user. In the case of a bed, this may take the form of a sheet of cardboard supporting a sheet of foam, a hole in the cardboard at the location of the vibrator motor, and a long rod which may be a strip of half-inch plywood to which the vibrator motor is attached by screws extruding through the foam so that the cardboard supports the rod and the vibrator motor without touching it. That structure is duplicated at the other side of the sheet of cardboard and the entire panel is placed between the foundation and the mattress. Electrical connections to each of the vibrator motors are made from a control unit which may be mounted to the panel or may be outside of the furniture.

In another similar system, the rod attached to each motor is secured to sinuous springs within a lounge chair. Still another alternate omits the cardboard panel and simply places the long rods between the foundation and mattress of a bed. Finally, it is possible to attach each vibrator motor to a linear or U-shaped metal rod and the two rods may then be slipped between a foundation and mattress for a bed in parallel positions.

The linear coupler may itself serve as the motor base, further simplifying the construction. The motor is secured to the linear coupler at at least two points, and the vibration path of the motor is centered closer to one attachment than to the other.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the best known embodiment has been described, the details may be changed without departing from the invention which is defined by the claims.

Figure 1:
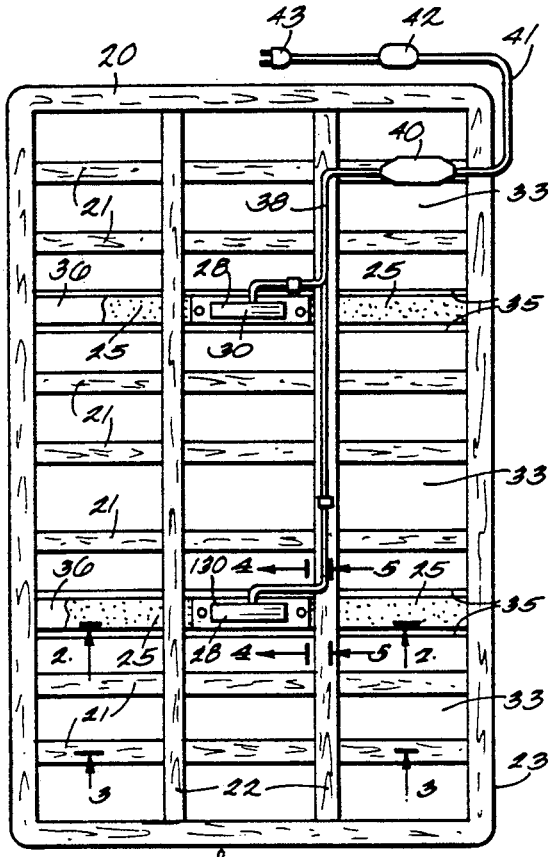
FIG. 1 is a bottom plan view of a bed with the vibrator of my invention mounted therein.
Figure 6:
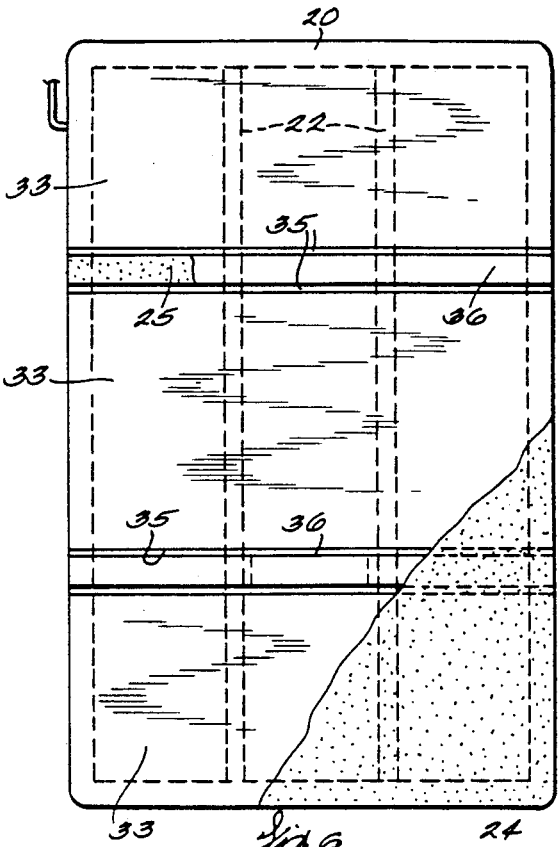
FIG. 6 is a top plan view of the mattress of FIG. 1 with portions broken away.
Figure 2:
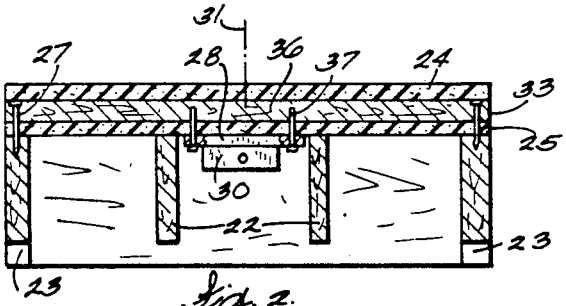
FIG. 2 is a cross-sectional view on line 2—2 of FIG. 1.
Figure 4:
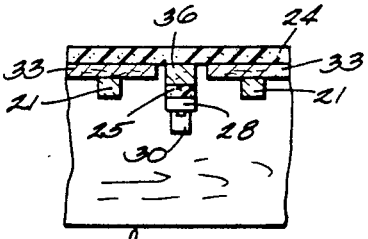
FIG. 4 is a cross-sectional view on line 4—4 of FIG. 1.
Figure 3:
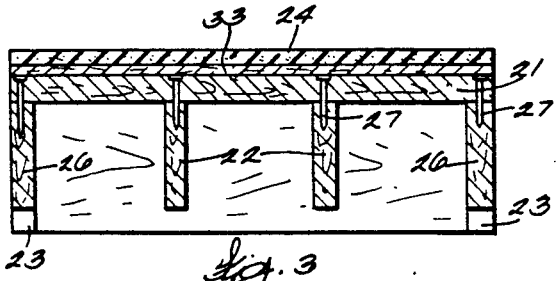
FIG. 3 is a cross-sectional view on line 3—3 of FIG. 1.
Figure 5:
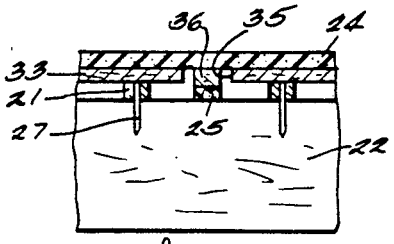
FIG. 5 is a cross-sectional view on line 5—5 of FIG. 1.

The preferred form of my invention is shown best in FIGS. 1 and 2. FIG. 1 is a bottom view of a conventional wooden foundation 20 for a bed having wood stringers 21 supported by longitudinal wood frame elements 22 all secured to an outer wooden frame 23 above which are the usual furniture foam padding 24, etc., all enclosed by a cloth cover which is secured at the sides of the outer wood frame 23. As shown in FIG. 2, my novel vibrator structures are placed near the upper surface of the foundation whereby they are hidden in the top view. FIG. 2 shows a vibrator motor 30 and a foam pad 25 and a linear resonator board or rod 36. A large cardboard panel 33 has no visible boundaries in the view of FIG. 1 because it is substantially co-extensive with the surface of the wooden frame 20. Looking now at FIG. 2, it may be seen that the cardboard panel 33 is attached by staples 27 or any other convenient means to wood stringers 21 of the wooden frame 20 and that the staples 27 also secure the foam padding 24 across an opening 35 (FIG. 4) in cardboard 33. The base 28 of vibratory motor 30 is secured to the long resonator board or rod 36, preferably formed of plywood, by means of any suitable fastenings here shown as screws 37 to provide it with a rigid mounting to the resonator board 36 but with a flexible connection between board 36 and cardboard layer 33 through foam pad 25. Thus, the cardboard layer 33 which is relatively flexible serves to position and support the vibrator motor 30 for vibrations along a line 31 at right angles to the resonator board 36 and to the surface of the furniture. The resonator board 36 carries vibrations efficiently from vibrator 30 to a linear area of the surface of the furniture.

Figure 8:
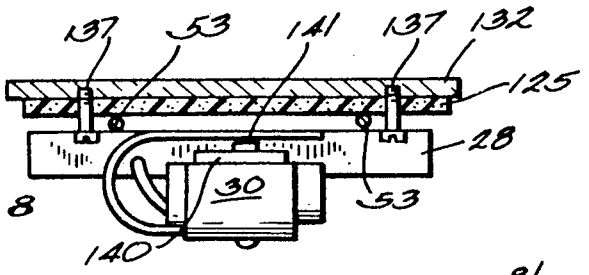
FIG. 8 is a cross-sectional view on line 8—8 of FIG. 7.
Figure 7:
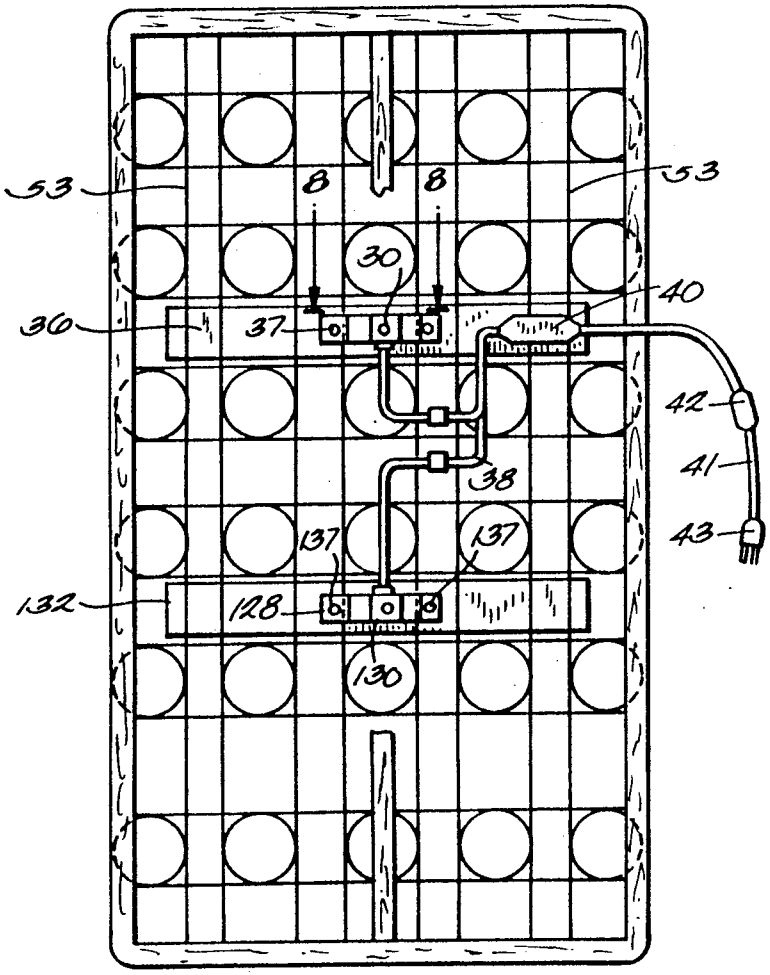
FIG. 7 is a top plan view of a coil spring with portions broken away to show a modified embodiment of my invention.

As best shown in FIGS. 7 and 8, the structure shown in FIG. 2 is duplicated by a parallel resonator rod or board 132 at a distance from the first resonator board 36 for a purpose that will shortly be described. A controller 40 receives power from an electric power source (not shown) to which it is coupled by a cord 41 which may desirably have a switch 42 and a wall plug 43. The controller 40 contains known means which converts the 60 Hertz alternating current to a unidirectional current which pulsates at 60 Hertz. In addition, the pulsating direct current is amplitude modulated by a unidirectional current which pulsates at a frequency of approximately 16 cycles per minute, or within a range of 15 to 20 cycles per minute, upon the current flowing to each vibrator motor 30. However, at any given moment the current flowing to one vibrator motor is 180° out of phase with the current flowing to the other vibrator motor 30 by means which are known in the art. The result is that the two vibrator motors 30 work in opposition to one another to produce a distinctive tactile sensation at a very low rate in addition to producing an audible sound or hum at the 60 Hertz frequency of the line current. If desired, means can be incorporated in controller 40 to change that frequency as well, within a range of about 30 Hertz to 100 Hertz. The preferred form of the amplitude modulated wave is a sine wave although other wave forms may be used. It would be practical to provide more than two sets of the equipment shown in FIG. 2 and to change the phase relationship of the waves supplied to each vibrator 30 accordingly so that, for instance, if there are three sets of the FIG. 2 equipment, the signal would be 120° out of phase from one unit to the next.

Figure 9:
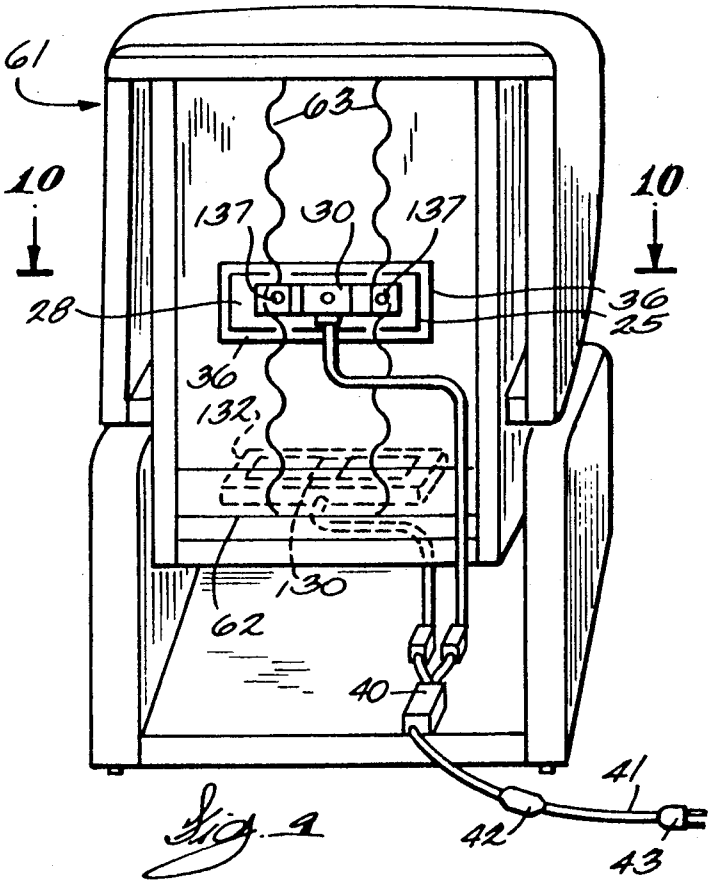
FIG. 9 is a rear perspective view of a lounge chair broken away to show a modified embodiment of my invention.
Figure 10:
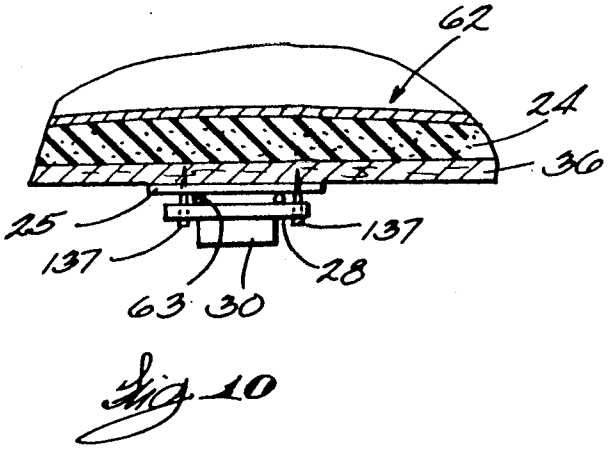
FIG. 10 is a view taken along lines 10—10 of FIG. 9.

In FIG. 9 the arrangement is similar, but the installation is shown in a lounge chair 61 having the back broken away to show sinuous springs 63 extending between a frame of the vibrator motor 30 and the resonator board or rod 36 and secured by fasteners 137. The same controller 40 would be used but the second vibrator motor 30 and its associated frame 28 and resonator board or rod 36 are mounted in the same manner in the seat 62 on sinuous springs 63. Again the relationship of the 16 cycle per minute amplitude modulated wave is 180° between one vibrator motor 30 and the other vibrator motor 130 at any given time.

FIG. 7 shown an arrangement similar to that illustrated in FIG. 1, but a second vibrator motor 130 and its resonator board 232 are secured by fasteners 137 through vibrator motor frame 128, past spring wires 53 conventionally found in a coil spring construction so that motors 30 and 130 and resonator boards 132 and 232 are held in parallel positions with respect to the bed spring 50 shown in FIG. 7.

FIG. 8 is a cross-sectional view on line 8—8 on FIG. 7, but could equally well serve as a cross-sectional view of the seat or back of the chair shown in FIG. 9. Wires 53 are fixed to the frame 50 and are disposed in a spaced apart side-by-side relation and are held between the frame 28 of the motor 30 and the resonator board 132 by fasteners 137 with a layer of padding material 125 between. As shown in FIG. 9, there is a second motor 130 in the seat 62 wherein each motor 30 and 130 excites a resonator board 132 and 232 to transmit the vibrations of motors 30 and 130 to spring 63 in a linear area that is parallel to the linear area excited by the other board and spaced from it. As described above, the excitation produced by one vibrator motor 30 is out of phase with the excitation produced by the other vibrator motor 130 due to the controller 40. As seen in FIG. 9, the motor 30 is mounted on and between a pair of springs 63. As shown in FIG. 8, the motor 30 is non-rotating and includes a coil 140 and a movable pole piece 141 oriented generally perpendicular to a plane containing the springs 53 to produce vibrations linearly in a direction generally perpendicular to the user contacting surface.

Figure 11:
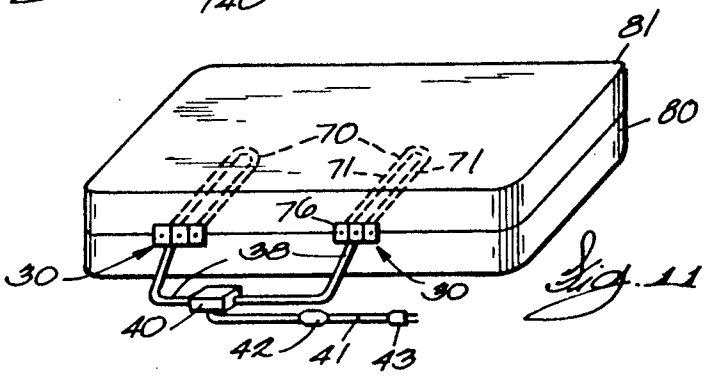
FIG. 11 is a perspective view of a foundation and mattress showing a modified version of my invention.
Figure 12:
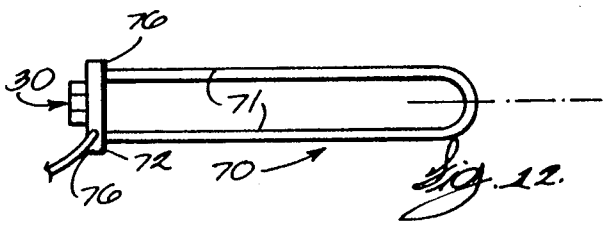
FIG. 12 is a top plan view of the vibrator and linear resonator of FIG. 11.

In FIGS. 11–12, the vibrator motor 30 and its frame 76 are mounted to a long doubled or U-shaped metal rod or tube 70 with long straight sides which serves the function of the resonator rod or board in the preceding embodiments. The excitation of motors 30 by controller 40 is the same as that described above and the effect is the same but because the rod 70 may be slid between a mattress and foundation without any permanent attachment, installation is extremely simple. In fact, the unit may be used as a portable unit in a hotel bed or the like.

Figure 13:
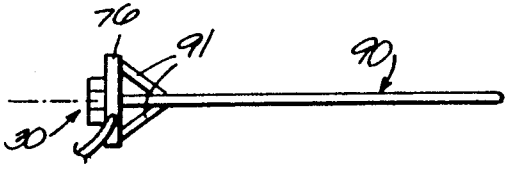
FIG. 13 is an alternate embodiment of the invention illustrated in FIG. 12.

FIG. 13 shows a still further modification. The U-shaped rod is replaced by a straight rod 90 braced by short struts 91 to frame 76 of vibrator motor 30.

In any embodiment using rods, either straight or U-shaped, motor 30 has a coil which is nearer to one mounting screw than to the other. The result is to skew the action of the vibrating motor 30. When the unit is placed below coil springs (FIGS. 7 and 11) or below any structure that can vibrate in a vertical plane, that is, a plane at right angles to the surface of the mattress or other furniture, the action of the vibrator and rod or rods induce a vertical vibration in the furniture which is highly desirable compared to other known systems.

What is claimed is:

1. In combination, an article of furniture having flexible covering means defining a user contacting surface and at least one non-rotating vibrator motor having a coil and a movable pole piece and constructed and arranged to produce vibrations primarily perpendicular to the user contacting surface, said article of furniture including frame means and at least two elongate resilient wire spring means disposed in a spaced apart, side-by-side relation below the covering means and on the side thereof opposite said user contacting surface, said spring means being secured to said frame means and comprising a portion of a resilient user support disposed below said flexible covering means and extending in a direction generally parallel to said contacting surface, support means for mounting said vibrator motor wherein said support means includes a resilient member, means rigidly securing said motor on said resilient member, said resilient member being secured on said resilient spring means for producing vibrations generally perpendicular to the user contacting surface and between said spring means whereby vibrations imparted by said motor to said spring means will be transferred by said spring means to the user through the flexible covering means.

2. The combination set forth in claim 1 wherein said spring means comprises sinuous springs disposed in a generally parallel relation, said vibrator motor being mounted on said pair of spring means and being disposed generally therebetween to produce vibrations generally perpendicular to said user contacting surface and between said springs.

3. The combination set forth in claim 2 wherein said article of furniture comprises a chair having a seat portion and a back portion, said spring means being located in the back portion.

4. The combination set forth in claim 3 wherein there is a second pair of sinuous spring means disposed in said seat portion, there being a second motor mounted on said second pair of spring means.

5. The combination set forth in claim 4 and including energizing means for energizing each of said motors by a current which pulsates at a frequency of 30–100 Hz and which is amplitude modulated at a second lower frequency, said energizing means amplitude modulating the current supplied to a first one of said motors out of phase with that supplied to the other motor.

6. The combination set forth in claim 5 wherein the energizing means energized said motors such that the phase difference between the amplitude modulation of the current applied to said motors is 180 electrical degrees.

7. The combination set forth in claim 6 wherein there is a second pair of sinuous springs means disposed in said seat, there being a second motor mounted on said second pair of springs.

8. The combination set forth in claim 1 wherein said vibrator motor is excited with direct current which pulsates at a frequency of 30–100 Hz.

9. For use with a mattress having flexible covering means defining a user contacting surface, at least one vibrator motor constructed and arranged to produce vibrations in a first direction, at least one resilient metallic rod means adapted to be disposed below the covering means and on the side thereof opposite said user contacting surface, said resilient rod means being constructed and arranged to be disposed below the mattress and generally parallel to said contacting surface, said vibrator motor being mounted on an end of said resilient rod means for inducing in said resilient rod means vibrations along in a direction perpendicular to the contacting surface whereby vibrations imparted by said motor to said flexible rod means will be transferred by said flexible rod means to the user through the mattress.

10. The combination set forth in claim 9 wherein said metallic rod is generally U-shaped.

11. The combination set forth in claim 9 wherein said metallic rod is disconnected from said article of furniture for the free positioning thereof.

* * * * *